US012760395B2

(12) United States Patent
Goto

(10) Patent No.: US 12,760,395 B2
(45) Date of Patent: Oct. 13, 2026

(54) BLACK HEART MALLEABLE CAST IRON AND METHOD FOR PRODUCING SAME

(71) Applicant: Kuwana Metals, Ltd., Kuwana (JP)

(72) Inventor: Ryo Goto, Tokyo (JP)

(73) Assignee: Kuwana Metals, Ltd., Kuwana (JP)

( * ) Notice: Subject to any disclaimer, the term of this patent is extended or adjusted under 35 U.S.C. 154(b) by 1015 days.

(21) Appl. No.: 17/909,346

(22) PCT Filed: Mar. 5, 2021

(86) PCT No.: PCT/JP2021/008746
§ 371 (c)(1),
(2) Date: Sep. 2, 2022

(87) PCT Pub. No.: WO2021/177454
PCT Pub. Date: Sep. 10, 2021

(65) Prior Publication Data

US 2023/0086395 A1 Mar. 23, 2023

(30) Foreign Application Priority Data

Mar. 6, 2020 (JP) ..... 2020-038913

(51) Int. Cl.
*C22C 37/10* (2006.01)
*C21D 5/14* (2006.01)
*C22C 33/08* (2006.01)

(52) U.S. Cl.
CPC ..... *C22C 37/10* (2013.01); *C21D 5/14* (2013.01); *C22C 33/08* (2013.01); *C21D 2211/005* (2013.01); *C21D 2211/006* (2013.01)

(58) Field of Classification Search
None
See application file for complete search history.

(56) References Cited

U.S. PATENT DOCUMENTS 2,227,217 A 12/1940 Crafts
2,260,998 A 10/1941 Lorig
(Continued)

FOREIGN PATENT DOCUMENTS

CN 85106684 A 3/1987
JP S46-17421 5/1971
(Continued)

OTHER PUBLICATIONS

Li et al. "The Preparation of High-Purity Iron (99.987%) Employing a Process of Direct Reduction-Melting Separation-Slag Refining." Materials 2020, 13, 1839.Apr. 14, 2020. (Year: 2020).*
(Continued)

*Primary Examiner* — Brian D Walck
(74) *Attorney, Agent, or Firm* — Morgan, Lewis & Bockius LLP

(57) ABSTRACT

The black heart malleable cast iron according to the present embodiment comprises a matrix of ferrite and lump graphite included in the matrix, the black heart malleable cast iron comprising 50 ppm or more and 100 ppm or less of boron, and 65 ppm or more and 200 ppm or less of nitrogen in a mass ratio, wherein a grain size of the matrix is 8.0 or more and 10.0 or less in terms of grain size number, numerically determined by comparison between a metallographic photograph and a standard grain size chart.

16 Claims, 2 Drawing Sheets

(56) References Cited

U.S. PATENT DOCUMENTS

| | | | | |
|---|---|---|---|---|
| 3,565,698 | A | 2/1971 | de Mercoyrol de Beaulieu | |
| 2020/0080173 | A1* | 3/2020 | Goto | C22C 33/08 |

FOREIGN PATENT DOCUMENTS

| | | | | |
|---|---|---|---|---|
| JP | H02-290944 | A | 11/1990 | |
| SU | 1723180 | A1 | 3/1992 | |
| SU | 1744141 | A1 | 6/1992 | |
| WO | 2006/072663 | A2 | 7/2006 | |
| WO | WO-2018180424 | A1 * | 10/2018 | C22C 37/10 |

OTHER PUBLICATIONS

Office Action issued in corresponding Chinese Patent Application No. 202180007637.1 dated Apr. 19, 2023.
"Microscopic Test Method of Steel—Grain Size", Japan Industrial Standards JIS G 0551, Japan Standards Institute, revised Jan. 21, 2013 and its concise explanation.
International Preliminary Report on Patentability and Written Opinion issued in related International Patent Application No. PCT/JP2021/008746 dated Sep. 15, 2022.
International Search Report issued in related International Patent Application No. PCT/JP2021/008746 dated Apr. 27, 2021.
International Preliminary Report on Patentability and Written Opinion issued in related International Patent Application No. PCT/JP2018/009527 dated Oct. 10, 2019.
International Search Report issued in related International Patent Application No. PCT/JP2018/009527 dated Jun. 12, 2018.
Extended European Search Report issued in related European Patent Application No. 18777936.8 dated Nov. 16, 2020.
Office Action issued in related Chinese Patent Application No. 201880013088.7 dated Feb. 1, 2021.
Office Action issued in related Chinese Patent Application No. 201880013088.7 dated Jun. 28, 2021.
Qingchun et al., "Shortening the Annealing Time of Black Heart Malleable Cast Iron by Adding Boron and Bismuth," Journal of Haerbin Industrial University, 2: 77-84 (1959) (see CN OA).
Peiwen, "Effect of Micro-alloying Elements on the Graphitization of Black Heart Malleable Cast Iron," Journal of Taiyuan Institute of Engineering, 27-44 (1964) (see CN OA).
Office Action issued in related Japanese Patent Application No. 2019-509184 dated Apr. 4, 2022.
Office Action issued in related U.S. Appl. No. 16/496,894 dated Jun. 8, 2022.
Yang Zhihai et al., "Study on Properties and Metallograph of Black Malleable Irons," Journal of Jiamusi University (Natural Science Edition), 27 (3): 398-401 (2009) (see English translation of Chinese Office Action).
Official Action issued in related European Patent Application No. 18777936.8 dated Feb. 2, 2024.
Office Action issued in related U.S. Appl. No. 16/496,894 dated Dec. 30, 2022.
BCIRA Broadsheet 41, "Nitrogen in cast iron," British Cast Iron Research Association (1971).

* cited by examiner

BLACK HEART MALLEABLE CAST IRON AND METHOD FOR PRODUCING SAME

TECHNICAL FIELD

The present disclosure relates to black heart malleable cast iron and a method for producing the same.

BACKGROUND ART

Cast irons expressed as a general term of iron-based materials can be classified into flake graphite cast iron, spheroidal graphite cast iron, malleable cast iron, and the like according to the existence form of carbon. The malleable cast irons can be further classified into white heart malleable cast iron, black heart malleable cast iron, pearlite malleable cast iron, and the like.

Black heart malleable cast iron according to the present disclosure is also simply called malleable cast iron and has the form in which graphite is present while being dispersed in a matrix made of ferrite. Black heart malleable cast iron is superior in mechanical strength compared to flake graphite cast iron and also excellent in toughness because of its ferrite matrix. For this reason, black heart malleable cast iron is widely used as material for producing automobile parts, pipe joints, and the like, which require mechanical strength.

For flake graphite cast iron and spheroidal graphite cast iron, flake or spheroidal graphite is precipitated in a cooling process after casting. In contrast, for black heart malleable cast iron, carbon in a cast iron obtained by cooling after casting is present in cementite form ($Fe_3C$), which is a compound of carbon with iron. Thereafter, the cast iron is heated to and held at a temperature of 720° C. or higher, so that the cementite is decomposed to precipitate graphite. Herein, the step of precipitating graphite by heat treatment is hereinafter referred to as "graphitization". Herein, the product after casting and before graphitization (intermediate product) is referred to as "cast iron" or "cast iron before graphitization", and the material after graphitization (including final product) is referred to as "black heart malleable cast iron". Cementite contained in the black heart malleable cast iron is preferably as little as possible from the viewpoint of increasing, for example, the mechanical strength.

Graphitization of the cast iron in the producing process of the black heart malleable cast iron takes a very long time. The graphitization comprises first stage graphitization where cementite liberated in austenite is decomposed at a temperature of 900° C. or higher, and second stage graphitization where cementite in pearlite is decomposed at a temperature of around 720° C. after the first stage graphitization. Both the first stage graphitization and the second stage graphitization generally take several hours to several tens of hours because those stages of graphitization proceed accompanied by the diffusion of carbon in the matrix and the precipitation of graphite. This prolonged graphitization leads to an increase in the production cost of black heart malleable cast iron.

To shorten the time required for the graphitization, various methods have been conventionally studied. For example, Patent Document 1 mentions that the time required for graphitization can be shortened by adjusting the content of silicon, which is an element that promotes graphitization, to be higher than the usual amount. Patent Document 2 mentions that the time required for graphitization can be shortened more than ever before by performing a heat treatment in a low temperature range of 100° C. to 400° C. for at least 10 hours.

Patent Document 3 of the patent application filed previously by the present applicant mentions a black heart malleable cast iron comprising at least one of bismuth and manganese as well as aluminum and nitrogen, wherein a grain size of the matrix is 8.0 or more and 10.0 or less in terms of grain size number, and method for producing a black heart malleable cast iron, which comprises the step of preheating a cast iron containing the above-mentioned additive elements at 275° C. or higher and 425° C. or lower and graphitizing the cast iron. In the black heart malleable cast iron mentioned in Patent Document 3, since the matrix is composed of fine crystal grains, the time required for graphitization can be significantly shortened as compared with the prior art. Patent Document 3 also mentions that when the cast iron before graphitization is preheated, a metallographic structure composed of fine crystal grains can be easily formed as compared with the case where the cast iron is not preheated.

PRIOR ART DOCUMENT

Patent Document

Patent Document 1: JP 46-17421 B
Patent Document 2: U.S. Pat. No. 2,227,217
Patent Document 3: WO 2018/180424

DISCLOSURE OF THE INVENTION

Problems to be Solved by the Invention

In the method mentioned in Patent Document 1, since the content of silicon that promotes graphitization is increased, a metallographic structure called "mottle" containing graphite crystallized during casting and subsequent cooling process (crystallized graphite) is likely to be formed depending on the shape of the casting mold, the cooling rate immediately after casting, and other cooling conditions. The crystallized graphite produced during casting does not disappear by the subsequent heat treatment, which causes a decrease in the mechanical strength of the black heart malleable cast iron. In the method mentioned in Patent Document 2, the time required for heat treatment performed at a temperature lower than the temperature required for graphitization is as long as about 8 hours to 10 hours. Therefore, the total heat treatment time for a heat treatment to be newly performed and a conventional graphitization combined is not necessarily shortened.

Among the methods for producing a black heart malleable cast iron mentioned in Patent Document 3, the preheating step is performed at a temperature of 275° C. or higher and 425° C. or lower. Meanwhile, as mentioned above, the graphitization is performed at a temperature of 720° C. or higher. Then, for example, when a continuous heat treatment furnace is used for a large number of cast irons, there is a problem that it is difficult to carry out graphitization after preheating under significantly different temperature conditions at the same processing speed.

When a large number of cast irons are processed at once, or a large size cast iron is processed, it is difficult to make the temperature of the cast iron uniform in the preheating and to process the cast iron under the same temperature conditions. Therefore, there is a problem that the quality of the black heart malleable cast iron may not be stable.

The present disclosure has been made in view of the above-mentioned problems, and it is an object of the present invention to provide a black heart malleable cast iron and a method for producing the same, which can complete graphitization within a short time without performing preheating and which can be stably employed at low cost without any risk of the formation of a mottle during casting.

Means for Solving the Problems

Aspect 1 (first embodiment) of the present invention provides:

a black heart malleable cast iron comprising a matrix of ferrite and lump graphite included in the matrix, the black heart malleable cast iron comprising 50 ppm or more and 100 ppm or less of boron, and 65 ppm or more and 200 ppm or less of nitrogen in a mass ratio, wherein a grain size of the matrix is 8.0 or more and 10.0 or less in terms of grain size number, numerically determined by comparison between a metallographic photograph and a standard grain size chart.

According to the first embodiment, when this cast iron contains a predetermined amount of boron and nitrogen, crystal grains of the matrix are refined, which makes it easier to form the metallographic structure in which the grain size of the matrix is 8.0 or more and 10.0 or less in terms of grain size number, as compared to the case where the predetermined amount of these elements is not contained.

Aspect 2 of the present invention provides:

the black heart malleable cast iron according to aspect 1, wherein when the content of boron is B (ppm) and the content of nitrogen is N (ppm) in a mass ratio, the values of B and N satisfy the formula (1) below. In this way, in a preferred embodiment, in the black heart malleable cast iron according to the present embodiment, when the content of boron is B (ppm) and the content of nitrogen is N (ppm) in a mass ratio, the values of B and N satisfy the following formula (1). In this case, it is possible to effectively prevent the mechanical strength, particularly the elongation, from being lowered due to the addition of excess boron.

$$N \geq 1.3B - 10 \quad (1)$$

Aspect 3 of the present invention provides:

the black heart malleable cast iron according to aspect 1 or 2, further comprising titanium, wherein when the content of titanium is Ti (ppm), the content of boron is B (ppm) and the content of nitrogen is N (ppm) in a mass ratio, the values of Ti, B and N satisfy the following formula (2):

$$N \geq 1.3B + 0.3Ti - 10 \quad (2)$$

Aspect 4 of the present invention provides:

the black heart malleable cast iron according to any one of aspects 1 to 3, wherein the lump graphite is present while being dispersed at positions of crystal grain boundaries of the matrix.

Aspect 5 of the present invention provides:

the black heart malleable cast iron according to any one of aspects 1 to 4, wherein an average particle diameter of the lump graphite is 10 micrometers or more and 40 micrometers or less.

Aspect 6 of the present invention provides:

the black heart malleable cast iron according to any one of aspects 1 to 5, wherein the number of particles of the lump graphite per square millimeter of a cross-sectional area thereof is 200 or more and 1,200 or less.

Aspect 7 of the present invention provides:

the black heart malleable cast iron according to any one of aspects 1 to 6, further comprising 2.0% or more and 3.4% or less of carbon, and 0.5% or more and 2.0% or less of silicon in a mass ratio, the balance being iron and inevitable impurities.

Aspect 8 of the present invention provides:

the black heart malleable cast iron according to any one of aspects 1 to 7, further comprising more than 0% and 1.0% or less of manganese in a mass ratio.

Aspect 9 (second embodiment) of the present invention provides:

a method for producing a black heart malleable cast iron, which comprises the steps of:

adjusting the composition of a molten metal obtained by melting raw materials, obtaining a cast iron comprising 2.0% or more and 3.4% or less of carbon, 0.5% or more and 2.0% or less of silicon, 50 ppm or more and 100 ppm or less of boron, and 65 ppm or more and 200 ppm or less of nitrogen in a mass ratio, the balance being iron and inevitable impurities, by casting using the molten metal with the composition adjusted, and graphitizing the cast iron at a temperature exceeding 680° C.

Aspect 10 of the present invention provides:

the method for producing a black heart malleable cast iron according to aspect 9, wherein a time for graphitizing the cast iron at the temperature exceeding 680° C. in the step of graphitizing the cast iron is 1 hour or more and 6 hours or less in total.

Aspect 11 of the present invention provides:

the method for producing a black heart malleable cast iron according to aspect 9 or 10, wherein the step of adjusting the composition of the molten metal comprises the step of:

adding a second molten metal after adding a nitrogen-containing compound to a first molten metal.

Aspect 12 of the present invention provides:

the method for producing a black heart malleable cast iron according to any one of aspects 9 to 11, wherein the step of adjusting the composition of the molten metal comprises the step of:

adding at least one of ferroboron and manganese nitride to the molten metal before casting to adjust the composition.

Aspect 13 of the present invention provides:

the method for producing a black heart malleable cast iron according to any one of aspects 9 to 12, wherein at least one of a cast iron or a black heart malleable cast iron produced by using the method for producing a black heart malleable cast iron according to any one of claims 9 to 12 is included in raw materials.

Effects of the Invention

According to the black heart malleable cast iron and the method for producing the same of the present embodiment, crystal grains of the matrix can be refined without performing preheating. As a result, the migration distance due to diffusion of carbon in the graphitization step can be shortened, thus greatly reducing the time required for a heat treatment after casting. In addition, the quality of the black heart malleable cast iron becomes stable and the refinement of crystal grains of the matrix leads to improvement of the mechanical strength of the black heart malleable cast iron.

BEST MODE FOR CARRYING OUT THE INVENTION

Figure 1:
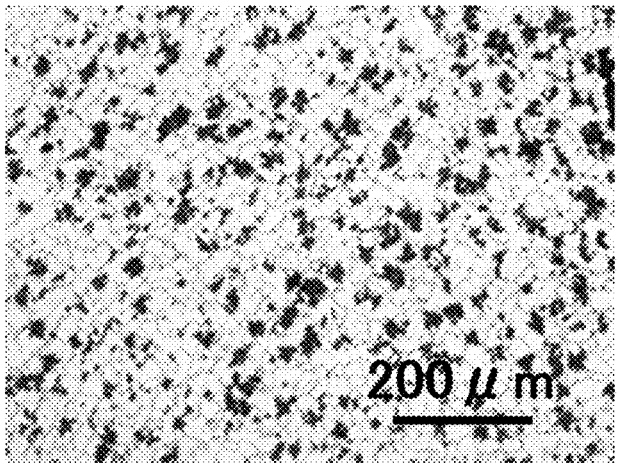
FIG. 1 is an example of a metallographic photograph of a black heart malleable cast iron according to the present embodiment.

Embodiments for carrying out the present invention will be described in detail below with reference to the accompanying drawings and tables. It should be noted that the embodiments mentioned herein are merely examples, and the embodiments for carrying out the present invention are not limited to the embodiments mentioned herein.

<Metallographic Structure>

The metallographic structure of a black heart malleable cast iron according to the present embodiment will be described.

In a first embodiment of the present invention, the black heart malleable cast iron has a matrix of ferrite. As used herein, the term "ferrite" refers to the a phase in the iron-carbon equilibrium diagram. In addition, as used in the present specification, the term "matrix" is a residual microstructure excluding graphite, and refers to a main phase or parent phase which occupies most of the volume (area in cross-sectional observation) of an alloy, among phases included in the alloy. Specifically, for example, when the cross-section of a sample is polished and the metallographic structure is observed with a microscope, in a case where the area ratio of ferrite to the whole microstructure of the black heart malleable cast iron is 80% or more, the ferrite is a main phase or parent phase that occupies most of the alloy, and corresponds to the matrix in the present embodiment. After the graphitization is completed, the matrix is composed of ferrite which hardly contains solid-solution carbon. Therefore, the black heart malleable cast iron according to the present embodiment has excellent toughness, similarly to the conventional black heart malleable cast iron.

The black heart malleable cast iron according to the present embodiment has lump graphite included in a matrix. As used herein, the term "lump graphite" refers to a precipitated phase that is made of graphite and has the form in which a plurality of graphite particles are agglomerated to form a lump aggregate. In the present embodiment, the fact that the lump graphite is "included in the matrix" means that the lump graphite is included while being surrounded by the ferrite matrix, and does not means that the graphite is solid-soluted in the matrix of ferrite.

In the black heart malleable cast iron according to the present embodiment, the grain size of the matrix is 8.0 or more and 10.0 or less in terms of grain size number, which is numerically determined by comparison between a metallographic photograph and a standard grain size chart. As used herein, the term "standard grain size chart" refers to a set of diagrammatic representations of grain boundaries in metallographic structures having various grain sizes. As the standard grain size chart, "Annex B (normative), Measurement of Grain Size—Standard Grain Size Chart" of "Microscopic Test Method of Steel—Grain Size" of Japan Industrial Standards JIS G 0551 ("Steels—Micrographic determination of the apparent grain size", Japan Standards Institute, revised on Jan. 21, 2013) is used. The microscopic test method for the steel-grain size mentioned in the Japan Industrial Standards is substantially the same as the ISO Standards (ISO 643: 2019). These standards specify a microscopic test method for measuring the grain size of ferrite or austenite of the steel. However, in the present disclosure, this method is applied correspondingly to the measurement of the grain size of the matrix of ferrite of the black heart malleable cast iron.

As used herein, the term "grain size number" refers to a value of G calculated by the following formula (3) using the average number m of crystal grains per square millimeter of cross-sectional area. In the following formula (3), G is a power index with a base of 2. For example, when m is 16, the grain size number G is 1. The smaller the grain size number, the coarser the grain size, and conversely, the larger the grain size number, the finer the grain size.

$$m = 8 \times 2^G \tag{3}$$

The comparison between the metallographic photograph and the standard grain size chart is performed, specifically, by comparing a micrograph showing the metallographic structure of a black heart malleable cast iron with the standard grain size chart illustrated at the same magnification as that of the micrograph, and then visually identifying the grain size number of the standard grain size chart that illustrates the grain size most similar to the grain size shown in the micrograph. In this comparison, unlike the methods specified in the above standards, the lump graphite parts included in the micrograph are ignored, whereby the comparison with the standard grain size chart is performed focusing only on the size of the grain boundary of the ferrite matrix. As used herein, the term "metallographic photograph" is not limited to a micrograph obtained by printing a metallographic structure on a paper, and may be image data or the like obtained by using a CCD camera installed in a metallographic microscope.

In a black heart malleable cast iron according to the prior art, lump graphite is not necessarily present at the position of the crystal grain boundary of the matrix, and is often present at a position near the center of the crystal grain of the matrix, distant from the crystal grain boundary of the matrix, or is often present across a plurality of crystal grain boundaries of the matrix. In addition, the grain size of the matrix may be often 7.5 or less in terms of grain size number. In the case of such a metallographic structure, carbon atoms must migrate through the matrix for a long distance by their diffusion until they are precipitated as lump graphite in the graphitization process. In some cases, the carbon atoms must migrate across a plurality of crystal grains of the matrix. Therefore, the completion of the graphitization process takes a long time of several tends of hours.

Meanwhile, in the black heart malleable cast iron according to the present embodiment, the grain size of the final product, i.e., the matrix obtained after the completion of graphitization is 8.0 or more in the grain size number. The crystal grains of this matrix are finer than those of the conventional black heart malleable cast iron. In the production process of the black heart malleable cast iron having such a metallographic structure, carbon atoms migrate due to their diffusion over a distance from the center of the refined matrix grain to the position of the corresponding crystal grain boundary at the longest to thereby reach the position of the crystal grain boundary, where the carbon atoms can be precipitated as graphite.

The diffusion rate of carbon atoms at the grain boundaries of the matrix is higher than the diffusion rate of carbon atoms in the crystal grains. In the black heart malleable cast iron according to the present embodiment, during the production process of the black heart malleable cast iron, carbon atoms necessary for precipitation and growth of the lump graphite, which is to be present at the positions of the crystal grain boundaries of the matrix, can be supplied to the lump graphite at high speed through the crystal grain boundaries of the matrix. In this way, by shortening the migration distance of carbon atoms due to their diffusion and making the crystal grain boundary usable as a diffusion path, the black heart malleable cast iron according to the present embodiment can significantly shorten the time required for the graphitization, as compared with the prior art.

When the grain size of the matrix is 8.0 or more in the grain size number, the migration distance of carbon atoms due to their diffusion until graphite is precipitated is short, which can exhibit the effect of shortening the graphitization time. The finer the grain size of the matrix is, the better the black heart malleable cast iron becomes. Due to this, there is no upper limit of the grain size number. However, the grain size number of the matrix in the black heart malleable cast iron does not exceed 10.0, commonly, even though it is extremely large. Thus, the grain size of the matrix of the black heart malleable cast iron in the present embodiment is 8.0 or more and 10.0 or less in the grain size number. The grain size number is preferably 8.5 or more.

Figure 2:
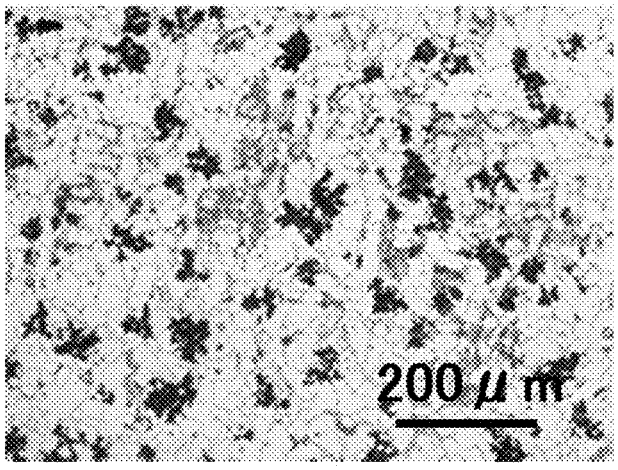
FIG. 2 is an example of a metallographic photograph of a black heart malleable cast iron according to the prior art.

The metallographic structure of the black heart malleable cast iron according to the present embodiment will be described while comparing with the prior art, using an actual example of the metallographic photograph. FIG. 1 is an example of a metallographic photograph of a black heart malleable cast iron according to the present embodiment. FIG. 2 is an example of a metallographic photograph of a black heart malleable cast iron according to the prior art. The lengths of the scale bars in the lower right of the drawings are all 200 micrometers. In FIG. 1 and FIG. 2, the light gray phase is a ferrite matrix. The black phase is a lump graphite included in the matrix. The lines seen in the matrix are the grain boundaries of the matrix visualized by etching. The grain size of the matrix of FIG. 1 is 9.0 in terms of grain size number, which is within the range of the grain size number in the present embodiment. The grain size of the matrix of FIG. 2 is 7.0, which is coarser than that of FIG. 1. In FIG. 1 and FIG. 2, it seems that there is no great difference in abundance of the lump graphite. However, in the prior art, as shown in FIG. 2, the lump graphite is accumulated to form a large lump. In contrast, in the present embodiment, the lump graphite is finely dispersed as shown in FIG. 1.

In a preferred embodiment, the black heart malleable cast iron according to the present embodiment is configured such that the lump graphite is present at the position of the grain boundary of the matrix. As used herein, the expression "lump graphite is present while being dispersed at the position of the grain boundary of the matrix" means that the lump graphite is present at the position located in the grain boundary between two ferrite crystal grains of the matrix and/or the position located in the grain boundary triple junction of three ferrite grains, in the metallographic structure of the black heart malleable cast iron as the final product. Lump graphite is hardly present across a plurality of grain boundaries of the matrix. Most of the lump graphite may be present at the positions of the crystal grain boundaries of the matrix. For example, in the metallographic photograph as shown in FIG. 1, 70 area % or more of the total area of the lump graphite in the micrograph is preferably present at the positions in the crystal grain boundaries of the matrix. The proportion of the lump graphite present at the positions of the grain boundaries in the total lump graphite is more preferably 80 area % or more, more preferably 90 area % or more, and most preferably 100 area %. The preferred embodiment of the present invention can allow the situation where a small amount of lump graphite is present at positions near the centers of the grains of the matrix away from the crystal grain boundaries of the matrix, or the situation where a small amount of lump graphite is present across four or more crystal grain boundaries of the matrix.

Moreover, as used herein, the expression "the lump graphite is present while being dispersed" means that the lump graphite is not present mostly at specific positions of the crystal grains located in parts of the matrix, but that the lump graphite is uniformly present at the positions of many crystal grains of the matrix. In other words, with regard to many crystal grains of the matrix, lump graphite is present at the positions of the crystal grain boundaries between the crystal grain and its surrounding crystal grains. The number of crystal grains with no lump graphite present at the corresponding crystal grain boundary is small. The lump graphite may be present in many crystal grains of the matrix. The preferred embodiment of the present invention mentioned above can allow the situation regarding the small number of crystal grains where no lump graphite is present or where lump graphite, if any, is present at the position near the center of the crystal grain rather than the corresponding crystal grain boundary.

When a precipitate is present at the position of a crystal grain boundary of the matrix, interphase boundaries are formed between the matrix and the precipitate. In general, the grain boundary energies at the interphase boundaries are smaller than the grain boundary energies at grain boundaries between the same phases. When small crystal grains are integrated with large crystal grains in the matrix to grow together, the movement of crystal grain boundaries is essential. However, in order for the crystal grain boundaries to move away from the position of the precipitate, a new crystal grain boundary must be formed instead of the interphase boundaries, which requires more energy to move the grain boundaries, compared to the case where any precipitate is not present. For this reason, the crystal grain boundaries are fixed to the position of the precipitate without moving, which inhibits the growth of grains. Such an effect is sometimes called "pinning effect" of grain boundaries exhibited by precipitates.

In the black heart malleable cast iron according to the present embodiment, when the lump graphite is present while being dispersed at the positions of the grain boundaries of the matrix, the growth of crystal grains in the matrix during the graphitization process is inhibited by the pinning effect. This pinning effect is exhibited for most of crystal grains. As a result, the metallographic structure having a matrix with the grain size inherent to the black heart malleable cast iron according to the present embodiment is more likely to be formed.

The black heart malleable cast iron according to the present embodiment tends to have improved mechanical strength as compared with the black heart malleable cast iron according to the prior art. Specifically, the tensile strength and elongation tend to be improved. The reason is not clear, but the improvement is probably considered to be related to the fact that the black heart malleable cast iron according to the present embodiment has finer grain size of the ferrite matrix than that of the black heart malleable cast iron according to the prior art, and that the lump graphite is present at the positions of the grain boundaries of the matrix.

In a preferred embodiment, in the black heart malleable cast iron according to the present embodiment, the average particle diameter of particles of the lump graphite is 10 micrometers or more and 40 micrometers or less. When the average particle diameter of particles of the lump graphite is 10 micrometers or more, the number of particles of the lump graphite does not increase so much, and thus the particles of the lump graphite tend to be easily present while being dispersed at the positions of the crystal grain boundaries of the matrix. On the other hand, when the average particle diameter of particles of the lump graphite is 40 micrometers or less, the number of particles of the lump graphite does not decrease so much, and thus the diffusion distance of carbon required for the growth of the lump graphite does not become so long. Thus, the time required for the graphitization tends to be easily shortened. Therefore, in the black heart malleable cast iron according to the present embodiment, the average particle diameter of particles of the lump graphite is preferably 10 micrometers or more and 40 micrometers or less. The average particle diameter of particles of the lump graphite is more preferably 12.0 micrometers or more, and still more preferably 15.0 micrometers or more. The average particle diameter of particles of the lump graphite is more preferably 19.0 micrometers or less, still more preferably 18.5 micrometers or less, and yet more preferably 18.0 micrometers or less.

In a preferred embodiment, in the black heart malleable cast iron according to the present embodiment, the number of particles of the lump graphite is 200 or more particles and 1,200 or less particles per square millimeter of the cross-sectional area thereof. Since the volume of graphite finally contained in the black heart malleable cast iron according to the present embodiment is substantially the same between the final cast irons, the larger the average particle diameter of particles of the lump graphite, the smaller the number of particles thereof, while the smaller the average particle diameter thereof, the larger the number thereof. When the number of particles of the lump graphite is 200 or more, the diffusion distance of carbon required for the growth of the lump graphite is shortened, so that the time required for the graphitization tends to be easily shortened. The larger the number of particles of the lump graphite is, the better the black heart malleable cast iron becomes. Due to this, there is no upper limit to the number of particles. However, the number of particles of the lump graphite per square millimeter of the cross-sectional area thereof, which graphite can be formed in a preferred embodiment of the present invention, does not exceed 1,200 at most. Therefore, the number of particles of the lump graphite per square millimeter of the cross-sectional area thereof is preferably 200 or more and 1,200 or less. The number of particles of the lump graphite per square millimeter of the cross-sectional area thereof is more preferably 300 or more and even more preferably 500 or more, and may be 1,000 or less.

Both "average grain size of lump graphite" and "number of particles of the lump graphite per square millimeter of the cross-sectional area thereof" in the present embodiment are determined based on the metallographic structure observed in any cut surface of the black heart malleable cast iron. More specifically, as mentioned later in Examples, the average particle diameter and the number of particles of the lump graphite per square millimeter of the cross-sectional area thereof are determined by measuring through computer image analysis by creating data about an image of the micrograph showing the metallographic structure of the black heart malleable cast iron used for identifying the grain size number, using a scanner, a CCD camera, or the like.

It should be noted that all of the grain size number, the average grain size, and the number of particles mentioned in the above description of the black heart malleable cast iron according to the present embodiment are measured values about the metallographic structure of the black heart malleable cast iron obtained after the completion of the graphitization process. The operations and effects of the present embodiment, such as the suppression of crystal grain growth and the shortening of the time required for graphitization, are exhibited mainly at an intermediate stage in progress of the graphitization process. However, it is difficult to numerically evaluate the metallographic structure at the intermediate stage of such a process. This is why the numerical values regarding the metallographic structure obtained after the completion of the graphitization process are substituted, for convenience.

<Composition of Black Heart Malleable Cast Iron>

An alloy composition (composition) of the black heart malleable cast iron according to the present embodiment will be described. As used herein, all the contents of respective elements are expressed in a mass ratio. The symbol "ppm" means that the numerical value with this symbol is the mass ratio expressed in parts per million. The symbol "% (percentage)" means that the number with this symbol is the mass ratio expressed as a percentage.

In a preferred embodiment, the black heart malleable cast iron according to the present embodiment contains 2.0% or more and 3.4% or less of carbon. When the carbon content is 2.0% or more, the melting point of the molten metal used for casting in the production process of the black heart malleable cast iron becomes 1400° C. or lower, which eliminates the need to heat a raw material to a high temperature for producing the molten metal, so that the black heart malleable cast iron tends to obviate a large-scale melting facility. At the same time, the viscosity of the molten metal becomes low, allowing the molten metal to easily flow, so that the molten metal is apt to be easily poured into the casting mold. When the carbon content is 3.4% or less, mottle is less likely to be formed at the time of casting and during the cooling process thereafter. Therefore, the carbon content is preferably set at 2.0% or more and 3.4% or less. More preferably, the carbon content is 2.5% or more and 3.2% or less.

In a preferred embodiment, the black heart malleable cast iron according to the present embodiment contains 0.5% or more and 2.0% or less of silicon. When the silicon content is 0.5% or more, the effect of promoting graphitization by silicon is obtained, so that the graphitization tends to be easily completed within a short time. When the silicon content is 2.0% or less, the effect of promoting graphitization by silicon does not become excessive, so that mottle is less likely to be formed at the time of casting and during the cooling process thereafter. Therefore, the silicon content is preferably set at 0.5% or more and 2.0% or less. The silicon content is more preferably 1.0% or more and 1.7% or less.

The black heart malleable cast iron according to the present embodiment contains 50 ppm or more and 100 ppm or less of boron, and 65 ppm or more and 200 ppm or less of nitrogen in a mass ratio. By simultaneously containing boron and nitrogen, the crystal grains of the ferrite matrix can be refined. When the boron content is 50 ppm or more, grain refinement is likely to occur in the presence of nitrogen. The higher the boron content, the finer the crystal grains. The content of boron is preferably 60 ppm or more. When the boron content is 100 ppm or less, it is possible to prevent a decrease in the strength and elongation of the black heart malleable cast iron. The boron content is preferably 90 ppm or less.

When the content of nitrogen is 65 ppm or more, grain refinement is likely to occur in the presence of boron. The nitrogen content is preferably 80 ppm or more. When the nitrogen content is 200 ppm or less, graphitization is less likely to be inhibited. The nitrogen content is preferably 170 ppm or less. In the prior art, the increase in soluble nitrogen was considered to significantly inhibit the progress of first stage graphitization and second stage graphitization. In the present embodiment, on the contrary, shortening of the graphitization time was realized by containing nitrogen as an essential component along with boron.

The reason why crystal grains of the ferrite matrix become fine by simultaneously containing boron and nitrogen in the present embodiment is considered to be based on the following mechanism. It is noted that the following mechanism is inferred by the present inventors based on the resultant experimental results and does not limit the technical scope of the present invention.

When the cast iron is heated to a temperature of 800° C. to 900° C., boron and nitrogen solid-soluted in the cast iron are combined to form boron nitride. The boron nitride formed here is considered to be a hexagonal boron nitride (h-BN) that is stable under normal pressure. Hexagonal boron nitride has a crystal structure similar to graphite. Therefore, it is considered that a large amount of graphite tends to be finely precipitated with this boron nitride serving as a nucleus during graphitization. As mentioned in the above description of the metallographic structure, when graphite precipitates and grows into lump graphite, the growth of grains of the matrix is inhibited by the pinning effect. As a result, it is considered that a metallographic structure having a matrix grain size peculiar to the black heart malleable cast iron according to the present embodiment is likely to be formed.

Figure 3:
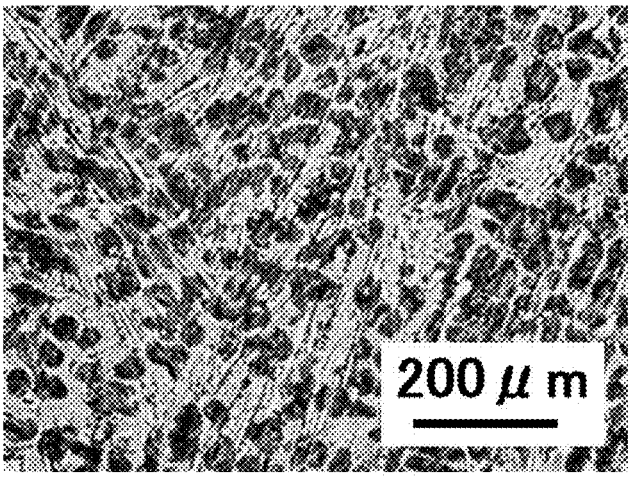
FIG. 3 is an example of a metallographic photograph of a cast iron before graphitization according to the present embodiment.
Figure 4:
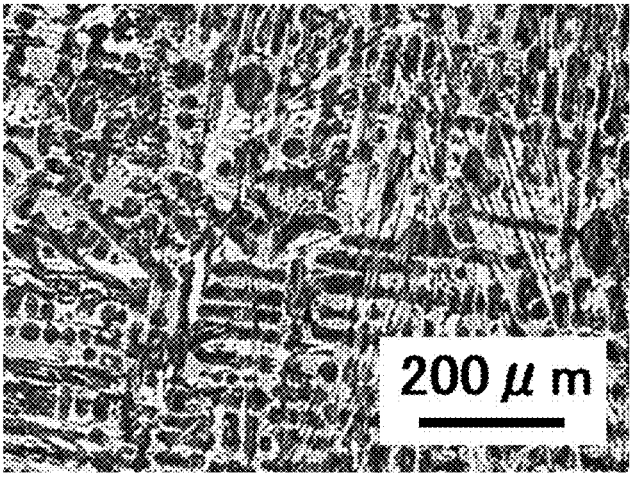
FIG. 4 is an example of a metallographic photograph of a cast iron before graphitization according to the prior art.

The content of boron may also affect the metallographic structure of the cast iron before graphitization. This will be described below. The metallographic structure of the cast iron before graphitization according to the present embodiment has features that are not found in the metallographic structure of the cast iron according to the prior art. FIG. 3 is an example of a metallographic photograph of a cast iron before graphitization according to the present embodiment. The content of boron is 68 ppm. FIG. 4 is an example of a metallographic photograph of a cast iron before graphitization according to the prior art. The content of boron is 27 ppm. The content of nitrogen is 110 ppm in any cast iron. The black part in FIG. 3 and FIG. 4 shows a phase in which austenite (γ-iron) precipitated as primary crystals in the casting process is transformed into pearlite in the subsequent cooling process. The light gray part is a phase called ledeburite, which is a eutectic structure of austenite and cementite.

In the cast iron of FIG. 4, primary austenite forms a dendritic structure. In contrast, the dendritic structure is finely divided and is present in the form of granules in the cast iron of FIG. 3, which has a high boron content. In FIG. 3, there is a tendency that the ledeburite region becomes coarser as compared with FIG. 4. The metallographic structure shown in FIG. 3 is a metallographic structure peculiar to the cast iron according to the present embodiment, and is similar to the structure of white pig iron in the case of a high solidification rate. The cast iron having the composition mentioned in Patent Document 3 before graphitization had a metallographic structure as shown in FIG. 4, and no metallographic structure as shown in FIG. 3 was observed. The details are unclear, but it is considered that such a difference in the metallographic structure of cast iron due to the content of boron has some influence on the subsequent miniaturization of the matrix after graphitization.

In a preferred embodiment, regarding the black heart malleable cast iron according to the present embodiment, when the content of boron is B (ppm) and the content of nitrogen is N (ppm) in a mass ratio, the values of B and N satisfy the following formula (1):

$$N \geq 1.3B - 10 \tag{1}$$

When the amounts of nitrogen and boron contained in black heart malleable cast iron satisfy the formula (1), there is a tendency that the metallographic structure after graphitization contains a ferrite matrix and a lump graphite contained in the matrix, as shown in FIG. 1, and cementite is less likely to remain. If boron is excessively contained in an amount in excess of the amount of boron specified in the formula (1), cementite tends to remain at the grain boundaries of the matrix in the graphitized metallographic structure, or the elongation of the black heart malleable cast iron tends to decrease. The details of this reason are unclear, but it is probably considered that boron that did not participate in the formation of boron nitride inhibits the progress of graphitization, or boron excessively solid-soluted in the matrix has some influence. The coefficient 1.3 of the boron content in the formula (1) is equal to the value obtained by dividing the atomic weight of nitrogen as 14 by the atomic weight of boron as 10.8. The fixed value 10 represents the amount of excess boron allowed with respect to the stoichiometric ratio of boron nitride. N-1.3B obtained by modifying the formula (1) may be, for example, −7 or more, further −5 or more, further 0 or more, and for example, 50 or less, further 30 or less.

In a preferred embodiment, if the black heart malleable cast iron according to the present embodiment further contains titanium, when the titanium content is Ti (ppm), the boron content is B (ppm) and the nitrogen content is N (ppm) in a mass ratio, the values of Ti, B and N satisfy the following formula (2). When titanium is contained, it is preferable that the contents of boron and titanium with respect to nitrogen satisfy the following formula (2) since satisfactory mechanical properties, particularly satisfactory elongation can be ensured. N-1.3B-0.3Ti obtained by modifying the formula (2) can be, for example, 100 or less, further 80 or less, and further 50 or less.

$$N \geq 1.3B + 0.3Ti - 10 \quad (2)$$

In a preferred embodiment, regarding the black heart malleable cast iron according to the present embodiment, when the content of manganese is Mn (%) and the content of sulfur is S (%) in a mass ratio as a balance between manganese and sulfur, the values of Mn and S satisfy the following equation (4). As shown in the following formula (4), it is considered that when (Mn-1.7S) is within the following range, manganese and sulfur, which are elements that inhibit graphitization, react with each other to form manganese sulfide, thus enabling completion of the graphitization process in a shorter time.

$$0.12 \geq (Mn - 1.7S) \geq 0.35 \quad (4)$$

The black heart malleable cast iron according to the present embodiment contains, in addition to the above elements, iron and inevitable impurities as the balance. There is exemplified, as one of the present embodiments, an embodiment in which the above-mentioned carbon, silicon, boron and nitrogen are contained, the balance being iron and inevitable impurities. Iron is a main element of the black heart malleable cast iron. In the present disclosure, inevitable impurities refer to inevitable impurities which are obviously present in the cast iron without being intentionally introduced during the production process until a desired final product as cast iron is obtained, and which are left unattended because they are unnecessary, but are present in trace amounts and do not necessarily adversely affect the properties of the cast iron. Specifically, trace metal elements such as chromium and sulfur originally contained in the raw material (for example, when the molten metal is prepared with cupola, sulfur is contained in the coke of the heat source), oxygen, titanium and the like, and compounds such as oxides mixed from the wall of the furnace during the production process, and compounds such as oxides produced by the reaction of molten metal with atmospheric gas correspond to the inevitable impurities in the present disclosure. Even if these inevitable impurities are contained in the black heart malleable cast iron in a total amount of 1.0% by mass or less, properties thereof are not significantly changed. The total content of the inevitable impurities is preferably 0.5% by mass or less.

In the present embodiment, it is permissible to contain elements other than the above carbon, silicon, boron and nitrogen. In this case, the type and content of the elements contained may be appropriately determined according to the desired properties as long as they do not significantly hinder the development of the effect in the present embodiment. Elements other than the above carbon, silicon, boron and nitrogen may be added in at least one of simple substances and compounds. The type and amount of the simple substances and compounds can be appropriately selected depending on the purpose of the addition. However, it is preferable to determine the type and amount of the element to be added after confirming that the effect is not significantly hindered in the present embodiment. Manganese is preferably exemplified as an element to be contained. Manganese may be contained, for example, in the amount within the range of more than 0% and 1.0% or less. From the viewpoint of fully exerting the effects of boron and nitrogen, it is preferable to suppress the contents of aluminum and titanium, which are more easily bonded to nitrogen than boron, as much as possible. For example, it is preferable to satisfy at least one of the aluminum content of 0.10% or less and the titanium content of 200 ppm or less in a mass ratio.

The method for analyzing the contents of carbon and sulfur in the black heart malleable cast iron and cast iron is a combustion-infrared absorption method. The combustion-infrared absorption method is preferable in that accurate analytical values of carbon and sulfur can be obtained. The method for analyzing the contents of silicon, boron, manganese, titanium and aluminum in the black heart malleable cast iron and cast iron is an inductively coupled plasma atomic emission spectroscopy. The method for analyzing the content of nitrogen in the black heart malleable cast iron and cast iron is an ammonia distillation-separation bis(1-phenyl-3-methyl-5-pyrazolone) (abbreviation: bispyrazolone) absorptionmetric method mentioned in Annex 2 of Japan Industrial Standards JIS G 1228 ("Iron and Steel—Methods for determination of nitrogen content", Japan Standards Institute, revised on Aug. 20, 1997). The above method for analyzing the amount of each of the above elements is also applied to the analysis of the molten metal obtained in the production process of the black heart malleable cast iron.

<Production Method>

The method for producing a black heart malleable cast iron according to the present embodiment will be described.

In the second embodiment of the present invention, the method for producing a black heart malleable cast iron comprises the steps of: adjusting the composition of a molten metal obtained by melting raw materials, obtaining a cast iron comprising 2.0% or more and 3.4% or less of carbon, 0.5% or more and 2.0% or less of silicon, 50 ppm or more and 100 ppm or less of boron and 65 ppm or more, and 200 ppm or less of nitrogen in a mass ratio, the balance being iron and inevitable impurities, by casting using the molten metal with the composition adjusted, and graphitizing the cast iron at a temperature exceeding 680° C. The content of each element specified here represents the content in the final product that has undergone the steps of casting and graphitization, similarly to the case of the black heart malleable cast iron according to the present embodiment. Since the reason for limiting the composition range of each element has already been described, the description thereof will be omitted here. There is exemplified, as one embodiment, an embodiment in which 2.0% or more and 3.4% or less of carbon, 0.5% or more and 2.0% or less of silicon, 50 ppm or more and 100 ppm or less of boron, and 65 ppm or more and 200 ppm or less of nitrogen are contained in a mass ratio, the balance being iron and inevitable impurities. The cast iron may further contain more than 0% and 1.0% or less of manganese in a mass ratio, similarly to the black heart malleable cast iron. It is preferable that the content of aluminum and titanium in the cast iron should be restricted similarly to the black heart malleable cast iron.

In the step of adjusting the composition of the molten metal obtained by melting raw materials, the contents of carbon, silicon, boron and nitrogen can be adjusted within the above range by adding a metal or a compounded form thereof to the molten metal, or the contents can also be adjusted by using the raw materials already containing the above elements, such as the use of steel scrap or the reuse of cast iron. Therefore, simple substances of carbon, silicon, boron, nitrogen and iron may be used as raw materials for casting to obtain the cast iron, and as for carbon, silicon and boron, ferrocarbon, ferrosilicon and ferroboron which are alloys of each element with iron may be used.

As used herein, the expression "adding the metal and/or the compounded form thereof (referred to as "compound or the like") to the molten metal" includes all aspects of an aspect of adding the molten metal to the compound or the like, an aspect of adding the compound or the like to the molten metal and an aspect of adding a compound or the like to a second molten metal mentioned later after adding a first molten metal mentioned later.

In order to add boron, it is possible to use a method of adding elemental boron and/or ferroboron to the molten metal. In a preferred embodiment, the method for producing a black heart malleable cast iron according to the present embodiment comprises the step of adding at least one of ferroboron and manganese nitride to the molten metal before casting to adjust the composition. Ferroboron is preferable because it is more soluble in the molten metal than the elemental boron. The content of boron in ferroboron is preferably 16% or more and 21% or less by mass ratio because it is easily available. In the method for producing a black heart malleable cast iron according to the present embodiment, the molten metal before casting contains boron in the amount that is close to that of boron in the black heart malleable cast iron according to the present embodiment, for example, 20 ppm or more and less than 50 ppm, as shown in Examples mentioned below, or the molten metal may satisfy the amount of the boron of black heart malleable cast iron according to the present embodiment. The molten metal having high boron content can be obtained by melting those containing, as raw materials, at least one of a cast iron produced by the method for producing a black heart malleable cast iron according to the present embodiment and a black heart malleable cast iron, specifically, for example, those containing scrap that contains boron and nitrogen produced by the implementation of the method for producing a black heart malleable cast iron according to the embodiment. Once boron is added at the stage of the molten metal, the content thereof hardly changes in the subsequent steps.

In order to add nitrogen, it is possible to use a method of bubbling nitrogen gas into the molten metal, a method of adding a nitrogen-containing compound which is a compound of nitrogen and other elements, and the like. For example, when an electric furnace is used to prepare a molten metal, the nitrogen content is often 60 ppm or more and 70 ppm or less, so that adjustment is usually required. As mentioned above, the method for analyzing the content of nitrogen in the black heart malleable cast iron and cast iron is an ammonia distillation-separation bis(1-phenyl-3-methyl-5-pyrazolone) (abbreviation: bispyrazolone) absorptionmetric method mentioned in Annex 2 of Japan Industrial Standards JIS G 1228 ("Iron and Steel—Methods for determination of nitrogen content", Japan Standards Institute, revised on Aug. 20, 1997).

Among the methods of adding nitrogen, the method of bubbling nitrogen gas to the molten metal is preferable in that only nitrogen can be added without changing other components. However, bubbling nitrogen may cause rapid drop in temperature of the molten metal. Therefore, care must be taken not to excessively increase the amount of nitrogen gas bubbled per unit time.

Meanwhile, among the methods of adding nitrogen, the method of adding a compound of nitrogen and other elements (nitrogen-containing compound) is preferable in that drop in temperature of the molten metal is less than that in the method of bubbling nitrogen gas. The nitrogen-containing compound used for adding nitrogen is preferably manganese nitride because it has relatively low melting point and is easy to add and mix. When a cupola is used to prepare the molten metal, sulfur derived from the heat source coke is contained in the molten metal as mentioned above. Since sulfur is an element that inhibits graphitization, sulfur is commonly combined with manganese to form manganese sulfide that does not affect graphitization. In this case, ferromanganese is used to add manganese. When manganese nitride is used instead of ferromanganese in the present embodiment, manganese nitride is decomposed in the molten metal, and nitrogen is used for adjusting the nitrogen content of the molten metal. Manganese is preferable because it combines with sulfur to form manganese sulfide. However, if manganese nitride is added in the amount in excess of the amount that contributes to the formation of manganese sulfide, excess manganese may inhibit graphitization, so that care must be taken not to excessively add manganese nitride.

As the raw material for iron, the above-mentioned steel scrap and the like can be used. The cast iron mentioned above can also be reused. When the steel scrap is used as the raw material for iron, carbon and silicon are already contained in common steel materials. Therefore, in many cases, these elements can be adapted to the composition range specified in the present embodiment only by melting the steel scrap. The steel scrap and recycled cast iron may contain a large amount of aluminum, titanium and the like, in addition to the above carbon and silicon. In this case, aluminum, titanium and the like are likely to react with nitrogen to form nitride which is more stable than boron nitride, so that care must be taken not to run out of nitrogen required for the synthesis of boron nitride.

In a preferred embodiment, in the method for producing a black heart malleable cast iron according to the present embodiment, as mentioned above, raw materials used for melting the molten metal before casting contain at least one of a cast iron and a black heart malleable cast iron produced by using the method for producing a black heart malleable cast iron according to the present embodiment. Here, "cast iron" refers to a product after casting and before graphitization, as mentioned above. The cast iron and black heart malleable cast iron contain parts called sprue and runner other than products, and so-called scrap such as products that are defective as a result of inspection.

The scrap (including at least one of the cast iron or black heart malleable cast iron) produced by the implementation of the method for producing a black heart malleable cast iron according to the present embodiment contains boron and nitrogen. Assuming that most of boron and nitrogen present in the scrap are hexagonal boron nitride, the melting point of the hexagonal boron nitride is about 3,000° C., so that there was concern about whether the hexagonal boron nitride can be melted and reused. It is also known that when boron is contained in the black heart malleable cast iron in the amount exceeding a certain amount, graphitization is inhibited. For this reason, there was also a concern that boron contained in the scrap might hinder graphitization. However, in the iron and steel field, it is known that boron nitride in the steel is decomposed into nitrogen and boron at a temperature sufficiently lower than the melting point of the hexagonal boron nitride, which is considered to be the same for the boron nitride in the cast iron. According to the study of the present inventors, it has been found that even when the raw material composed only of the scrap is melted, graphitization is not inhibited if the contents of boron and nitrogen are properly controlled as shown in the present embodiment, thus enabling the production of the black heart malleable cast iron according to the present embodiment.

In order to prepare the molten metal by melting raw materials, it is possible to use means for melting with a known melting facility (melting furnace) such as a cupola or an electric furnace. In the method for producing a black heart malleable cast iron according to the present embodiment, since the carbon content is 2.0% by mass or more, the temperature required for melting does not exceed 1,400° C. Therefore, there is no need for a large-scale melting facility with an ultimate temperature exceeding 1,400° C.

For example, the step of obtaining a cast iron may include that after melting raw materials in the melting furnace to prepare a molten metal, the molten metal is discharged in a ladle, and the composition and temperature of the molten metal are adjusted in the ladle, and then casting is performed by pouring the molten metal into a casting mold from the ladle. As mentioned above, the composition of the components can be adjusted in the ladle by adjusting raw materials to be used.

In the step of adjusting the composition of the molten metal, when the nitrogen-containing compound such as manganese nitride mentioned above is added to the molten metal to adjust the nitrogen content of the molten metal, it is preferable to comprise the step of adding a second molten metal after adding the nitrogen-containing compound to a first molten metal. According to this embodiment, the amount of nitrogen in the molten metal can be easily adjusted by suppressing decomposition and volatilization when the nitrogen-containing compound (preferably manganese nitride) comes into contact with the molten metal. For example, when the composition of the molten metal is adjusted with a ladle, the molten metal in the ladle remaining after pouring into the casting mold last time is used as the first molten metal, and the nitrogen-containing compound is added to the first molten metal, and then the molten metal discharged from the melting furnace is added as the second molten metal. The first molten metal may be either the molten metal remaining in the ladle as mentioned above, or the molten metal with the unadjusted composition that is first discharged from the melting furnace into the ladle. When the latter molten metal with the unadjusted composition is used as the first molten metal, it is possible to omit the step of adding the nitrogen-containing compound to the first molten metal and adding the second molten metal.

In order to further enhance the effect of suppressing the decomposition of the nitrogen-containing compound, it is preferable that the temperature of the first molten metal is lower than that of the second molten metal. For example, when the first molten metal is the remaining molten metal, the temperature of the first molten metal can be controlled in the range of about 1,320 to 1,350° C., and when the second molten metal is the molten metal discharged from the melting furnace, the temperature of the second molten metal can be controlled in the range of approximately 1,460 to 1,500° C. Furthermore, it is preferable that the mass of the first molten metal is less than that of the second molten metal. The mass of the first molten metal is less than that of the second molten metal, thereby, it is easy to realize the relationship between the temperatures of the first molten metal and the second molten metal mentioned above. For example, the amount of the first molten metal accounts for 1% or more and less than 50% of the total molten metal in a mass ratio.

The method for producing a black heart malleable cast iron according to the present embodiment comprises the step of obtaining a cast iron by casting. In the production method according to the present embodiment, it is possible to use, as the casting mold used for casting, a known casting mold such as a mold obtained by forming a molding sand, or a metal mold. A cast iron cast in the casting mold is taken out by disassembling the cooled casting mold after casting. The cast iron is further separated into a part of the product, and parts such as sprue and runner other than the product. The parts other than the product can be remelted as the scrap.

The method for producing a black heart malleable cast iron according to the present embodiment comprises the step of graphitizing the cast iron at a temperature exceeding 680° C. after casting. In the production method according to the present embodiment, it is possible to use, as means for graphitizing, a known heat treatment furnace such as a gas combustion furnace or an electric furnace.

The graphitization is the step specific to the method for producing a black heart malleable cast iron. In the graphitization step, the product obtained by casting is heated to a temperature exceeding 680° C. and then 720° C. corresponding to the A1 transformation point to decompose cementite, thus precipitating graphite. In addition, the matrix made of austenite is cooled to transform the austenite into ferrite, thereby making it possible to impart the toughness to the cast iron. The step of graphitizing the cast iron is divided into a first stage graphitization and a second stage graphitization performed after the first stage graphitization. Preferably, the graphitization step preferably comprises the first stage graphitization which comprises heating at a temperature exceeding 900° C., and the second stage graphitization in which a start temperature of 720° C. or higher and 800° C. or lower, and a completion temperature is 680° C. or higher and 720° C. or lower.

The first stage graphitization is the step of decomposing cementite in austenite within the temperature range exceeding 900° C. to precipitate graphite. Carbon produced by decomposing the cementite in the first stage graphitization contributes to the growth of the lump graphite. The temperature at which the first stage graphitization is performed is preferably 950° C. or higher and 1,100° C. or lower. A more preferable temperature range is 980° C. or higher and 1,030° C. or lower.

In the method for producing a black heart malleable cast iron according to the present embodiment, the time for performing the first stage graphitization can be significantly shortened by the effect of the present embodiment, as compared with the prior art. The actual time for the first stage graphitization can be appropriately determined depending on the size of an annealing furnace, the amount of the cast iron to be treated, and the like. The time required for the first stage graphitization in the prior art takes several hours or more to several tens of hours, whereas the time required for the first stage graphitization in the present invention takes at most 3 hours, typically 1 hour or less, which is sufficient. Depending on the conditions of the graphitization, the first stage graphitization in the present embodiment can be completed even in 45 minutes or less in excess of 30 minutes.

The second stage graphitization is the step of decomposing the cementite in the pearlite within the temperature range that is below the temperature at which the first stage graphitization is performed, thereby precipitating graphite and ferrite. The second stage graphitization is preferably performed while gradually decreasing the temperature of the cast metal from a second stage graphitization start temperature to a second stage graphitization completion temperature in order to promote the growth of the lump graphite and ensure the transformation from austenite to ferrite. The average cooling rate from the second stage graphitization start temperature to the second stage graphitization completion temperature is more preferably 1.5° C./minute or less, more preferably 1.0° C./minute or less. From the viewpoint of growth of the lump graphite and transformation to ferrite, the lower the average cooling rate is, the better the cast iron becomes. However, from the viewpoint of ensuring productivity, the lower limit of the average cooling rate may be set to approximately 0.20° C./minute.

The second stage graphitization start temperature is preferably 720° C. or higher and 800° C. or lower. A more preferable temperature range of the second stage graphitization start temperature is 740° C. or higher and 780° C. or lower. The second stage graphitization completion temperature is a temperature of 680° C. or higher and 720° C. or lower and is preferably a temperature that is lower than the second stage graphitization start temperature. A more preferable temperature range of the second stage graphitization completion temperature is 690° C. or higher and 710° C. or lower.

In the method for producing a black heart malleable cast iron according to the present embodiment, the time for performing the second stage graphitization can be significantly shortened by the effect of the present embodiment, as compared with the prior art. The actual time for the second stage graphitization can be appropriately determined depending on the size of the annealing furnace, the amount of the cast iron to be processed, and the like. The time required for the second stage graphitization in the prior art takes several hours or more to several tens of hours, similarly to the first stage graphitization in the prior art, whereas the time required for the second stage graphitization in the present embodiment takes at most 3 hours and typically suffices for 1 hour or less. Depending on the conditions of the graphitization, the second stage graphitization in the present invention can also be completed even in 45 minutes or less in excess of 30 minutes.

In a preferred embodiment, in the method for producing a black heart malleable cast iron according to the present embodiment, the time for graphitizing the cast iron at a temperature exceeding 680° C. in the graphitization step is 1 hour or more and 6 hours or less in total. As used herein, the expression "time for graphitizing the cast iron at a temperature exceeding 680° C." refers to the total time of the time for holding the temperature of the cast iron at the first graphitization temperature and the time for holding the temperature of the cast iron at the second graphitization temperature. The total graphitization time is preferably 5 hours or less, and more preferably 3 hours or less. The above-mentioned time refers to the period of time that elapses after a part near the center of the cast iron reaches the above-mentioned temperature range.

The method for producing a black heart malleable cast iron according to the present embodiment is a method for producing a black heart malleable cast iron that has the above-mentioned chemical composition (composition) and metallographic structure. The black heart malleable cast iron produced by the method for producing black heart malleable cast iron according to the present embodiment, in particular, the black heart malleable cast iron after the graphitization step comprises a matrix of ferrite and the lump graphite contained in the matrix, and contains the above-mentioned amount of boron and nitrogen. In addition, the grain size of the matrix is 8.0 or more and 10.0 or less in terms of the grain size number, numerically determined by comparison between the metallographic photograph thereof and the standard grain size chart. In a preferred embodiment, the average particle diameter of particles of the lump graphite is 10 micrometers or more and 40 micrometers or less.

<Others>

The influences of the alloy composition (composition) and the production method on the metallographic structure of the black heart malleable cast iron according to the present embodiment will be described.

The black heart malleable cast iron according to the present embodiment has the features of the component that it has a matrix of ferrite and the lump graphite contained in the matrix, and also contains 50 ppm or more and 100 ppm or less of boron, and 65 ppm or more and 200 ppm or less of nitrogen in a mass ratio. The black heart malleable cast iron according to the present embodiment also has features of the metallographic structure that the grain size of the matrix is 8.0 or more and 10.0 or less in terms of the grain size number numerically determined by the comparison between the metallographic photograph thereof and the standard grain size chart. These features are the essential subjects for specifying the present invention in the first embodiment.

In order to produce the black heart malleable cast iron having the above-mentioned features, the method for producing the same needs to have the step of graphitizing the cast iron at a temperature exceeding 680° C. This condition is the condition that enables the present invention to be implemented. In the present embodiment, there is no need to perform the preheating step performed at 275° C. or higher and 425° C. or lower as mentioned in Patent Document 3. Therefore, the time required for the heat treatment can be shortened and the production cost can be reduced as compared with the prior art that requires preheating. However, in the present embodiment, the heat treatment of the cast iron at a temperature of lower than 680° C. is not excluded.

EXAMPLES

First Example

In First Example, the influence of the amount of boron added to the molten metal containing a certain amount of nitrogen on the metallographic structure and mechanical strength of the black heart malleable cast iron was examined.

A molten metal (700 kg) obtained by blending raw materials to contain 3.0% of carbon and 1.5% of silicon in a mass ratio, the balance being iron and inevitable impurities, was discharged in a ladle. Then, ferroboron containing 18% of boron was added to the molten metal in the amount at six levels within the range of 56 g to 336 g, and after stirring, the molten metal was immediately poured into a casting mold to obtain six different types of cast irons. The resultant cast irons contained, in addition to carbon and silicon in the above amounts, 110 ppm of nitrogen derived from the raw materials and 0.35% of manganese derived from the raw materials.

Then, the cast iron obtained by casting was heated from room temperature to 980° C. over 45 minutes and held for 1 hour to perform first stage graphitization. Subsequently, after cooling the cast iron to 760° C., the second stage graphitization was performed while cooling from 760° C. to 720° C. over 1 hour to fabricate six types of samples Nos. 1 to 6 of the black heart malleable cast iron. The carbon content of the samples thus fabricated was analyzed by a combustion-infrared absorption method, and the contents of silicon, boron and manganese were analyzed by an inductively coupled plasma atomic emission spectroscopy. All the samples contained 3.0% of carbon, 1.5% of silicon, and 0.35% of manganese derived from the raw material of iron in a mass ratio. The content of nitrogen was measured by an ammonia distillation-separation bis(1-phenyl-3-methyl-5-pyrazolone) (abbreviation: bispyrazolone) absorptionmetric method mentioned in Annex 2 of Japan Industrial Standards JIS G 1228 ("Iron and Steel—Methods for determination of nitrogen content", Japan Standards Institute, revised on Aug. 20, 1997). The results of the analysis of boron and nitrogen, and the values obtained by substituting the analysis results into N-1.3B derived from the formula (1) are shown in Table 1. However, in Table 1, regarding the boron content of samples Nos. 2 and 3, the estimated value of the boron content estimated from the amount of ferroboron added is mentioned in parentheses.

TABLE 1

| Sample No. | Boron content (ppm) | Nitrogen content (ppm) | N-1.3B (ppm) | Grain size (grain size number) | Remaining of cementite | Strength (MPa) | Elongation (%) |
|---|---|---|---|---|---|---|---|
| 1 | 27 | 110 | 75 | 7.0 | — | — | — |
| 2 | (39) | 110 | 59 | 7.5 | Cementite remains | 331 | 9.8 |
| 3 | (55) | 110 | 39 | 8.0 | Cementite remains | 328 | 11.7 |
| 4 | 68 | 110 | 22 | 8.5 | None | 346 | 13.8 |
| 5 | 90 | 110 | −7 | 8.5 | A small amount of cementite remains | 331 | 10.9 |
| 6 | 100 | 110 | −20 | 9.0 | A small amount of cementite remains | 315 | 6.9 |

After a cut surface of the sample thus fabricated was polished and the grain boundaries thereon were etched with nital, the metallographic structure of the cut surface of the sample was observed with an optical microscope, and then a metallographic photograph thereof was taken with a CCD camera installed in the optical microscope. An example of the metallographic photograph of sample No. 4 is shown in FIG. 1 and an example of the metallographic photograph of sample No. 1 is shown in FIG. 2, respectively. In all samples Nos. 1 to 6, the area ratio of ferrite to the metallographic structure was 80% or more.

Then, the grain size of the ferrite matrix was measured by comparing the metallographic photograph thus taken with "Annex B (normative), Measurement of Grain Size—Standard Grain Size Chart" of "Microscopic Test Method of Steel—Grain Size" of Japan Industrial Standards JIS G 0551 ("Steels—Micrographic determination of the apparent grain size", Japan Standards Institute, revised on Jan. 21, 2013). In this comparison, the lump graphite parts included in the metallographic photograph are ignored, whereby the comparison with the standard grain size chart is performed focusing only on the size of the grain boundaries of the ferrite matrix. In addition, the presence or absence of remaining cementite was determined from the metallographic photograph. Further, test pieces for a tensile test were fabricated from the resulting samples, and the strength (tensile strength) and elongation of the test pieces were measured by a tensile tester. The results of these evaluations are summarized in Table 1.

As is apparent from Table 1, all samples Nos. 3 to 6 satisfied the ranges of the contents of boron and nitrogen according to the present embodiment. Regarding samples Nos. 1 and 2, the boron content was less than 50 ppm which is the lower limit of the composition range. Taking into account the grain size of the ferrite matrix, all samples Nos. 3 to 6 satisfied the range of the grain size number according to the present embodiment. Regarding samples Nos. 1 and 2, the grain size number is less than the lower limit of 8.0, and the grain size was coarser than those of samples Nos. 3 to 6. That is, among the samples shown in Table 1, samples Nos. 3 to 6 correspond to Examples of the black heart malleable cast iron and the method for producing the same according to the present embodiment.

As can be seen from First Example mentioned above, according to the black heart malleable cast iron and the method for producing the same according to the present embodiment, the graphitization time can be significantly shortened as compared with the prior art without performing preheating mentioned in Patent Document 3.

As shown in FIG. 1, in the metallographic structures of the black heart malleable cast irons of samples Nos. 3 to 6 that correspond to Examples of the present invention, many particles of lump graphite were present at the position located in the grain boundary between two ferrite crystal grains of the matrix and/or the position located in the grain boundary triple junction of three ferrite grains. The lump graphite was hardly present across four or more grain boundaries of the matrix.

In addition, the lump graphite is not present mostly at specific positions of the crystal grains located in parts of the matrix, and it is uniformly present at the positions of many crystal grains of the matrix. More specifically, in most of crystal grains of the matrix, the lump graphite is present at the positions of the crystal grain boundaries between crystal grains and their surrounding crystal grains, and there are a small number of crystal grains that have no lump graphite at the positions of their crystal grain boundaries. That is, the lump graphite was present while being dispersed at the positions of the crystal grain boundaries of the matrix.

In contrast, as shown in FIG. 2 for sample No. 1, in the metal structure of the black heart malleable cast iron of samples Nos. 1 and 2 in which the boron content was less than 50 ppm which is the lower limit of the composition range, many particles of the lump graphite may be agglomerated to form large lumps, and some of lumps of the lump graphite may be present across four or more crystal grain boundaries of the matrix. In addition, many particles of the lump graphite were present mostly at specific positions of the crystal grains located in parts of the matrix. Moreover, a great number of crystal grains that have no lump graphite present at the positions of their crystal grain boundaries were observed.

In sample No. 3 among the samples corresponding to Examples of the present invention, cementite remained in the metallographic structure, which suggests that graphitization was not completely completed. In sample No. 4 having higher boron content than that of sample No. 3, no cementite remained. In samples Nos. 5 and 6 having higher boron content, a small amount of cementite remained again. It is considered that this is because graphitization was inhibited due to the excessive boron content relative to the nitrogen content.

Taking into account the mechanical strength of the samples corresponding to Examples of the present invention, as shown in Table 1, the strength and elongation showed maximum values in sample No. 4. Also in samples Nos. 3 and 5 in which cementite remains, the strength and elongation were not much different from those of sample No. 4. As mentioned above, it is considered that the improvement in strength and elongation is related to the refinement of the grain size of the ferrite matrix. In sample No. 6, the mechanical strength decreased, and particularly, the elongation significantly decreased as compared with other samples. The decrease in elongation in sample No. 6 cannot be explained only by remaining of cementite. It is considered that the increase in amount of boron solid-soluted in the matrix may have an influence.

As mentioned above, in a preferred embodiment, regarding the black heart malleable cast iron according to the present embodiment, when the content of boron is B (ppm) and the content of nitrogen is N (ppm) in a mass ratio, the values of B and N satisfy the formula (1). Among First Example, regarding sample No. 6, the value on the right side of the formula (1) is 120, which is larger than the nitrogen amount 110 on the left side, so that the formula (1) is not satisfied. Regarding sample No. 5, the value on the right side of the equation (1) is 107, which is slightly smaller than the nitrogen amount 110 on the left side. That is, samples Nos. 3 to 5 correspond to a preferred embodiment of the present invention, and it can be said that the decrease in elongation due to excess boron is suppressed in these samples.

Second Example

In Second Example, the influence of lengthening the graphitization time as compared with First Example was examined. The cast iron before graphitization, which is the same as samples Nos. 3 to 6 of First Example, was heated from room temperature to 980° C. over 1 hour and 10 minutes and held for 1 hour and 20 minutes to perform first stage graphitization. Subsequently, after cooling the cast iron to 760° C., the second stage graphitization was performed while cooling from 760° C. to 720° C. over 1 hour and 20 minutes to fabricate four types of samples Nos. 8 to 11 of the black heart malleable cast iron. The samples thus fabricated were evaluated in the same manner as in First Example. The results of these evaluations are summarized in Table 2.

TABLE 2

| Sample No. | Boron content (ppm) | Nitrogen content (ppm) | N-1.3B (ppm) | Grain size (grain size number) | Remaining of cementite | Strength (MPa) | Elongation (%) |
|---|---|---|---|---|---|---|---|
| 8 | (55) | 110 | 39 | 8.5 | None | 338 | 12.3 |
| 9 | 68 | 110 | 22 | 8.5 | None | 356 | 15.1 |
| 10 | 90 | 110 | −7 | 9.0 | None | 331 | 10.9 |
| 11 | 100 | 110 | −20 | 9.5 | None | 313 | 7.4 |

As is apparent from Table 2, all samples Nos. 8 to 11, which satisfy the ranges of the contents of boron and nitrogen according to the present embodiment, satisfied the range of the grain size number according to the present embodiment. That is, all samples Nos. 8 to 11 shown in Table 2 correspond to Examples of the black heart malleable cast iron and the method for producing the same according to the present embodiment.

Comparing the results of Tables 1 and 2 for samples with the same boron and nitrogen contents, in the latter with long graphitization time, there was a tendency that the grain size number of the ferrite matrix slightly becomes larger, and that the strength and elongation are slightly improved. It is considered that this is because the formation of boron nitride progressed and the crystal grains of ferrite became finer as the time required for raising the temperature from room temperature to 980° C., which is the temperature of the first stage graphitization, became longer.

Meanwhile, as can be seen from the comparison between sample No. 11 and other samples, the contents of boron and nitrogen are preferable to satisfy the formula (1) from the viewpoint of ensuring satisfactory elongation. Further, as can be seen from the results in Table 2 above, for suppression of the decrease in elongation, satisfying the formula (1) is more effective than extending the graphitization time to thereby suppress the residual cementite in the production process.

Third Example

In Third Example, the method for adjusting the nitrogen content and whether or not the scrap of the cast iron and black malleable cast iron according to the present embodiment can be reused as raw materials were examined. The target composition of the sample was as follows: 3.0% of carbon, 1.5% of silicon, 70 ppm of boron, and 160 ppm of nitrogen in a mass ratio. Using an electric furnace, the mass of the raw materials used for single melting was 50 kg.

In sample No. 12 of Third Example, an alloy produced in an electric furnace was used as a raw material used for melting. The content of boron in the alloy was 33 ppm, and the content of nitrogen was 76 ppm. In order to melt 50 kg of this alloy and to adjust the composition of the resultant molten metal, 16 g of ferroboron having a boron content of 16% and 100 g of manganese nitride having a nitrogen content of 28%, and 15 g of elemental bismuth was added to the molten metal, and after stirring, the molten metal was immediately poured into a casting mold, whereby the molten metal was cast to obtain a cast iron. The resultant cast iron was graphitized under the same conditions as in First Example to obtain a black heart malleable cast iron of sample No. 12. The resultant black heart malleable cast iron was evaluated in the same manner as in First Example.

In sample No. 13 of Third Example, a cast iron (recycled cast iron) before graphitization produced by the method for producing a black heart malleable cast iron according to the present embodiment was used as a raw material used for melting. The content of boron in the recycled cast iron was 69 ppm, and the content of nitrogen was 87 ppm. In order to melt 50 kg of this recycled cast iron and to adjust the composition of the resultant molten metal, 100 g of manganese nitride having a nitrogen content of 28% and 15 g of elemental bismuth were added to the resultant molten metal. After stirring, the molten metal was immediately poured into a casting mold, whereby the molten metal was cast to obtain a cast iron. The resultant cast iron was graphitized under the same conditions as in First Example to obtain sample No. 13 of a black heart malleable cast iron of. The resultant black heart malleable cast iron was evaluated in the same manner as in First Example.

In sample No. 14 of Third Example, a black heart malleable cast iron (recycled black heart malleable cast iron) produced by the method for producing a black heart malleable cast iron according to the present embodiment was used as a raw material used for melting. The content of boron in the recycled cast iron was 68 ppm, and the content of nitrogen was 82 ppm. In addition, the carbon content of the recycled black heart malleable cast iron was reduced to 2.70% by decarburization in the process of graphitization. In order to melt 50 kg of this recycled cast iron and to adjust the composition of the resultant molten metal, the carbon content was increased to 3.04% by adding graphite powder. Then, 100 g of manganese nitride having a nitrogen content of 28% and 15 g of elemental bismuth were added to the resultant molten metal. After stirring, the molten metal was immediately poured into a casting mold, whereby the molten metal was cast to obtain a cast iron. The resultant cast iron was graphitized under the same conditions as in First Example to obtain sample No. 14 of a black heart malleable cast iron. The resultant black heart malleable cast iron was evaluated in the same manner as in First Example. The carbon, boron and nitrogen contents (unit is % or ppm by mass ratio) before and after component adjustment and the evaluation results of black heart malleable cast iron for samples Nos. 12 to 14 are summarized in Table 3.

TABLE 3

| Sample No. | State | Carbon content (%) | Boron content (ppm) | Nitrogen content (ppm) | Grain size (grain size number) | Remaining of cementite | Strength (MPa) | Elongation (%) |
|---|---|---|---|---|---|---|---|---|
| 12 | Before adjustment | 3.12 | 33 | 76 | 8.5 | None | 331 | 9.7 |
| | After adjustment | 3.03 | 77 | 160 | | | | |
| 13 | Before adjustment | 3.11 | 69 | 87 | 8.5 | None | 347 | 11.3 |
| | After adjustment | 3.06 | 68 | 156 | | | | |
| 14 | Before adjustment | 2.70 | 68 | 82 | 8.5 | None | 342 | 11.1 |
| | After adjustment | 3.04 | 67 | 160 | | | | |

As is apparent from Table 3, regarding all samples Nos. 12 to 14 of the black heart malleable cast irons, the boron amount and the nitrogen amount after adjusting the composition satisfied the range of the boron and nitrogen contents according to the present embodiment, and also satisfied the range of the grain size number. That is, all samples Nos. 12 to 14 shown in Table 3 correspond to the Examples of the black heart malleable cast iron and the method for producing the same according to the present embodiment. No remaining cementite was observed in all the samples, and the mechanical strength was not inferior to those of First and Second Examples. As can be seen from the results of Third Example, manganese nitride can be used to adjust the nitrogen content. It was also found that the effects of the present disclosure can be exhibited without problems even when the cast iron and black heart malleable cast iron scrap (reused cast iron) according to the present embodiment are melted and reused as the molten metal.

Fourth Example

In Fourth Example, the balance of the contents of elements other than nitrogen and boron was examined. A molten metal (700 kg) obtained by blending the raw materials to contain 3.0% of carbon and 1.5% of silicon, the balance being iron and inevitable impurities, was discharged in a ladle. In sample No. 15 of Fourth Example, 1,400 g of an alloy containing 5% of nitrogen and 70% of manganese, the balance being iron balance, and 135 g of ferroboron containing 18% of boron were added to the molten metal discharged in the ladle, and after stirring and further collecting a sample for analyzing the composition of the molten metal, the molten metal was immediately poured into a casting mold, whereby the molten metal was cast to obtain a cast iron.

In sample No. 16 of Fourth Embodiment, 1,100 g of an alloy containing 10% of nitrogen and 90% of manganese, and 160 g of ferroboron containing 18% of boron were added to the molten metal discharged in the ladle, and after stirring and further collecting a sample for analyzing the composition of the molten metal, the molten metal was immediately poured into a casting mold, whereby the molten metal was cast to obtain a cast iron.

In sample No. 17 of Fourth Embodiment, 1,400 g of an alloy containing 5% of nitrogen and 70% of manganese, the balance being an iron alloy, and 200 g of ferroboron containing 18% of boron were added to the molten metal discharged in the ladle, and after stirring and further collecting a sample for analyzing the composition of the molten metal, the molten metal was immediately poured into a casting mold, whereby the molten metal was cast to obtain a cast iron. The results of analyzing the composition in the same manner as in First Example using samples collected from the molten metal of samples Nos. 15 to 17 are shown in Table 4. The sulfur content was analyzed by a combustion-infrared absorption method.

TABLE 4

| Sample No. | Carbon (%) | Silicon (%) | Manganese (%) | Sulfur (%) | Boron (ppm) | Nitrogen (ppm) | Titanium (ppm) |
|---|---|---|---|---|---|---|---|
| 15 | 3.11 | 1.37 | 0.49 | 0.127 | 74 | 177 | 112 |
| 16 | 3.05 | 1.52 | 0.51 | 0.115 | 86 | 132 | 116 |
| 17 | 3.15 | 1.41 | 0.47 | 0.099 | 93 | 139 | 114 |

According to Table 4, the contents of boron and nitrogen of the compositions of the molten metals of all samples Nos. 15 to 17 of Fourth Example are within the range of the present embodiment. From this, it is presumed that the components of the black heart malleable cast iron after graphitization are also within the range of the present embodiment. In addition, these samples contain manganese contained in the alloy added, sulfur contained in coke as the heat source, and a trace amount of titanium contained in iron as the raw material.

Then, the cast iron obtained by casting was subjected to first stage graphitization and second stage graphitization under the same conditions as in First Embodiment, and the sample after the graphitization treatment was subjected to observation of the metallographic structure and evaluation of the mechanical strength by the same method as in First Example. The evaluation results are shown in Table 5. In Table 5, the calculated values of N-1.3B, N-1.3B-0.3Ti and Mn-1.7S based on the nitrogen content N (ppm), the boron content B (ppm), the titanium content Ti (ppm), the manganese content Mn (%) and the sulfur content S (%) in a mass ratio among the component analysis values of the molten metal shown in Table 4 are collectively shown. Further, the presence or absence of crystallized graphite when observing the fracture surface of the cast iron before graphitization is also shown in Table 5.

TABLE 5

| Sample No. | N-1.3B (ppm) | N-1.3B-0.3Ti (ppm) | Mn-1.7S (%) | Crystallized graphite | Cementite | Strength (MPa) | Elongation (%) |
|---|---|---|---|---|---|---|---|
| 15 | 80.8 | 47.2 | 0.27 | None | None | 342 | 12.2 |
| 16 | 20.2 | −14.3 | 0.32 | Observed | Slightly observed | 305 | 7.3 |
| 17 | 18.1 | −16.1 | 0.30 | Observed | Slightly observed | 302 | 7.9 |

As is apparent from Table 5, no crystallized graphite is present in the metallographic structure of the fracture surface after casting in sample No. 15, and no cementite is observed in the metallographic structure after the graphitization treatment. As mentioned above, "crystallized graphite" refers to graphite that crystallizes when the molten metal is cooled inside a casting mold, and is distinguished from lump graphite in the metallographic structure after graphitization shown in FIG. 1. Moreover, the mechanical strength is not inferior to the values of other Examples. The reason for this is presumed that that manganese and sulfur, which are elements that inhibit graphitization, react with each other to form manganese sulfide, so that the graphitization process is completed within a short time. Meanwhile, in samples Nos. 16 and 17, crystallized graphite was observed in the fracture surface after casting, and cementite was slightly observed in the metallographic structure after the graphitization treatment. In addition, as is apparent from the comparison between sample No. 15 and samples Nos. 16 and 17, it is preferable that the formula (2) is satisfied so that boron does not become excessive relative to the nitrogen and titanium contents, from the viewpoint of ensuring satisfactory mechanical strength, especially high elongation.

Fifth Example

In Fifth Example, a method of adding manganese nitride was examined as one of the methods of containing nitrogen. In Fourth Example mentioned above, manganese nitride was set in advance on the bottom of the ladle in all the samples, and the molten metal was poured into the ladle, followed by mixing. In contrast, in Fifth Example, 1,100 g of an alloy containing 10% of nitrogen and 90% of manganese, and 135 g of ferroboron containing 18% of boron were added to the surface of 90 kg of the molten metal containing no manganese nitride or the like added therein in the ladle (remaining molten metal in the ladle after previously pouring into the casting mold, first molten metal), followed by mixing and further holding for "holding time after adjusting the composition" shown in Table 6 below. Then, a second molten metal was added to the ladle until the total weight of the molten metal reached 700 kg, and after stirring, samples for analyzing the components of the molten metal were collected. Using the collected samples, the contents of manganese, nitrogen and boron were analyzed. The analysis results are shown in Table 6. In addition, "base melt" in Table 6 and Table 7 below means a molten metal containing no manganese nitride or the like added therein.

TABLE 6

| Holding time after adjustment of composition (minutes) | Manganese (%) | Nitrogen (ppm) | Boron (ppm) |
|---|---|---|---|
| Base melt | 0.406 | 118 | 39 |
| 1.5 | 0.518 | 146 | 76 |
| 5 | 0.519 | 151 | 78 |
| 10 | 0.525 | 150 | 79 |

As is apparent from Table 6, even by the above addition method, the same amounts of manganese and nitrogen as in Fourth Example were observed. Further, even when the second molten metal was added after holding for 10 minutes after adding manganese nitride or the like, no significant decrease in the content of each component was observed.

Then, 1,100 g of an alloy containing 10% of nitrogen and 90% of manganese, and 135 g of ferroboron containing 18% of boron were added to the surface of 50 kg of the molten metal containing no manganese nitride or the like added therein in the ladle (remaining molten metal in the ladle after previously pouring into the casting mold, first molten metal), followed by mixing and further standing for 5 minutes. Then, a second molten metal was added to the ladle until the total weight of the molten metal reached 700 kg, followed by holding for "holding time after the addition of the second molten metal" in Table 7 below. Samples for analyzing the components of the molten metal were then collected and the contents of manganese, nitrogen and boron of the samples were analyzed. The analysis results are shown in Table 7.

TABLE 7

| Holding time after addition of second molten metal (minutes) | Manganese (%) | Nitrogen (ppm) | Boron (ppm) |
|---|---|---|---|
| Base melt | 0.406 | 122 | 39 |
| 2.5 | 0.513 | 152 | 76 |
| 10 | 0.527 | 150 | 77 |

As is apparent from Table 7, even when the second molten metal was added after adding manganese nitride to a small amount of the molten metal and left to stand for a while, no significant decrease in content of each component was observed. It was found that according to this method, there is no need to set manganese nitride on the bottom surface of the ladle and can be added to the surface of the molten metal even in the case of continuous operation. It was also found that even if the molten metal containing manganese nitride and ferroboron added therein was held for 10 minutes, the composition of the molten metal did not change significantly and there was no problem in casting.

The contents of the description includes the following aspects disclosed in Japanese Patent Application No. 2020-038913, which is a priority document of the present application.

Aspect a1

A black heart malleable cast iron comprising a matrix of ferrite and lump graphite included in the matrix, the black heart malleable cast iron comprising 50 ppm or more and 100 ppm or less of boron, and 65 ppm or more and 170 ppm or less of nitrogen in a mass ratio, wherein a grain size of the matrix is 8.0 or more and 10.0 or less in terms of grain size number, numerically determined by comparison between a metallographic photograph and a standard grain size chart.

Aspect a2

The black heart malleable cast iron according to aspect a1, wherein when the content of boron is B (ppm) and the content of nitrogen is N (ppm) in a mass ratio, the values of B and N satisfy the following formula (1):

$$N \geq 1.3B - 10 \quad (1)$$

Aspect a3

The black heart malleable cast iron according to aspect a1 or a2, wherein the lump graphite is present while being dispersed at positions of crystal grain boundaries of the matrix.

Aspect a4

The black heart malleable cast iron according to any one of aspects a1 to a3, wherein an average particle diameter of the lump graphite is 10 micrometers or more and 40 micrometers or less.

Aspect a5

The black heart malleable cast iron according to any one of aspects a1 to a4, wherein the number of particles of the lump graphite per 1.00 square millimeter of a cross-sectional area thereof is 200 or more and 1,200 or less.

Aspect a6

The black heart malleable cast iron according to any one of aspects a1 to a5, further comprising 2.0% or more and 3.4% or less of carbon, and 0.5% or more and 2.0% or less of silicon in a mass ratio, the balance being iron and inevitable impurities.

Aspect a7

A method for producing a black heart malleable cast iron, which comprises the steps of:

casting a casting material comprising 2.0% or more and 3.4% or less of carbon, 0.5% or more and 2.0% or less of silicon, 50 ppm or more and 100 ppm or less of boron, and 65 ppm or more and 170 ppm or less of nitrogen in a mass ratio, the balance being iron and inevitable impurities, and graphitizing the cast metal at a temperature exceeding 680° C.

Aspect a8

The method for producing a black heart malleable cast iron according to aspect a7, wherein a time for graphitizing the cast metal at the temperature exceeding 680° C. in the step of graphitizing the cast metal is 1 hour or more and 6 hours or less in total.

Aspect a9

The method for producing a black heart malleable cast iron according to aspect a7 or a8, which comprises the step of:

adding at least one of ferroboron and manganese nitride to the molten metal before casting to adjust the composition.

Aspect a10

The method for producing a black heart malleable cast iron according to any one of aspect a9, wherein at least one of a cast iron or a black heart malleable cast iron produced by using the method for producing a black heart malleable cast iron according to any one of aspects a7 to a9 is included in raw materials used when the molten metal before casting is melted.

This application claims priority based on Japanese Patent Application No. 2020-038913 filed on Mar. 6, 2020, the disclosure of which is incorporated by reference herein.

The invention claimed is:

1. A black heart malleable cast iron comprising a matrix of ferrite and lump graphite included in the matrix, the black heart malleable cast iron comprising 50 ppm or more and 100 ppm or less of boron, and 65 ppm or more and 200 ppm or less of nitrogen in a mass ratio, wherein the black heart malleable cast iron excludes bismuth, the black heart malleable cast iron excludes aluminum, when the content of boron is B (ppm) and the content of nitrogen is N (ppm) in a mass ratio, the values of B and N satisfy the following formula (1), and a grain size of the matrix is 8.0 or more and 10.0 or less in terms of grain size number, numerically determined by comparison between a metallographic photograph and a standard grain size chart;

$$N \geq 1.3B - 10. \quad (1)$$

2. The black heart malleable cast iron according to claim 1, further comprising titanium, wherein when the content of titanium is Ti (ppm), the content of boron is B (ppm) and the content of nitrogen is N (ppm) in a mass ratio, the values of Ti, B and N satisfy the following formula (2):

$$N \geq 1.3B + 0.3Ti - 10. \quad (2)$$

3. The black heart malleable cast iron according to claim 2, further comprising 2.0% or more and 3.4% or less of carbon, and 0.5% or more and 2.0% or less of silicon in a mass ratio, the balance being iron and inevitable impurities.

4. The black heart malleable cast iron according to claim 1, wherein the lump graphite is present while being dispersed at positions of crystal grain boundaries of the matrix.

5. The black heart malleable cast iron according to claim 1, wherein an average particle diameter of the lump graphite is 10 micrometers or more and 40 micrometers or less.

6. The black heart malleable cast iron according to claim 1, wherein the number of particles of the lump graphite per square millimeter of a cross-sectional area thereof is 200 or more and 1,200 or less.

7. The black heart malleable cast iron according to claim 1, further comprising 2.0% or more and 3.4% or less of carbon, and 0.5% or more and 2.0% or less of silicon in a mass ratio, the balance being iron and inevitable impurities.

8. The black heart malleable cast iron according to claim 7, further comprising more than 0% and 1.0% or less of manganese in a mass ratio.

9. The black heart malleable cast iron according to claim 1, further comprising more than 0% and 1.0% or less of manganese in a mass ratio.

10. A method for producing the black heart malleable cast iron of claim 1, which comprises the steps of:

adjusting the composition of a molten metal obtained by melting raw materials, obtaining a cast iron comprising 2.0% or more and 3.4% or less of carbon, 0.5% or more and 2.0% or less of silicon, 50 ppm or more and 100 ppm or less of boron, and 65 ppm or more and 200 ppm or less of nitrogen in a mass ratio, the balance being iron and inevitable impurities, by casting using the molten metal with the composition adjusted, the cast iron wherein when the content of boron is B (ppm) and the content of nitrogen is N (ppm) in a mass ratio, the values of B and N satisfy the following formula (1), and graphitizing the cast iron at a temperature exceeding 680° C.;

$$N \geq 1.3B - 10. \quad (1)$$

11. The method for producing a black heart malleable cast iron according to claim 10, wherein a time for graphitizing the cast iron at the temperature exceeding 680° C. in the step of graphitizing the cast iron is 1 hour or more and 6 hours or less in total.

12. The method for producing a black heart malleable cast iron according to claim 10, wherein the step of adjusting the composition of the molten metal includes the step of:

adding a second molten metal after adding a nitrogen-containing compound to a first molten metal.

13. The method for producing a black heart malleable cast iron according to claim 10, wherein the step of adjusting the composition of the molten metal includes the step of:

adding at least one of ferroboron and manganese nitride to the molten metal before casting to adjust the composition.

14. The method for producing a black heart malleable cast iron according to claim 10, wherein at least one of a cast iron or a black heart malleable cast iron produced by using the method for producing a black heart malleable cast iron according to claim 9 is included in raw materials.

15. The method for producing a black heart malleable cast iron according to claim 10, further comprising titanium, wherein when the content of titanium is Ti (ppm), the content of boron is B (ppm) and the content of nitrogen is N (ppm) in a mass ratio, the values of Ti, B and N satisfy the following formula (2):

$$N \geq 1.3B + 0.3Ti - 10. \quad (2)$$

16. A black heart malleable cast iron comprising a matrix of ferrite and lump graphite included in the matrix, the black heart malleable cast iron comprising 50 ppm or more and 100 ppm or less of boron, and 156 ppm or more and 200 ppm or less of nitrogen in a mass ratio, wherein when the content of boron is B (ppm) and the content of nitrogen is N (ppm) in a mass ratio, the values of B and N satisfy the following formula (1), and a grain size of the matrix is 8.0 or more and 10.0 or less in terms of grain size number, numerically determined by comparison between a metallographic photograph and a standard grain size chart;

$$N \geq 1.3B - 10. \quad (1)$$

* * * * *